United States Patent [19]

Marsden et al.

[11] 3,969,920

[45] July 20, 1976

[54] SPLICER FOR REINFORCING BARS

[75] Inventors: Ronald Eric Marsden; Franklyn Walter Webb; George Rukavina, all of Mississauga, Canada

[73] Assignee: Stricon Products Limited, Mississauga, Canada

[22] Filed: June 25, 1974

[21] Appl. No.: 482,927

[30] Foreign Application Priority Data

June 28, 1973 Canada ..... 175205

[52] U.S. Cl. ..... 72/415; 29/237

[51] Int. Cl.[2] ..... B21D 39/04

[58] Field of Search ..... 72/402, 407, 415; 29/516, 517, 237

[56] References Cited

UNITED STATES PATENTS

| | | | |
|---|---|---|---|
| 2,064,129 | 12/1936 | Temple, Jr. | 29/517 |
| 2,320,680 | 6/1943 | Temple | 29/516 |
| 2,916,812 | 12/1959 | Milo | 29/237 |
| 3,726,122 | 4/1973 | Dawson | 29/237 |
| 3,771,343 | 11/1973 | Dawson | 72/402 |
| 3,823,597 | 7/1974 | Hanback | 72/402 |
| 3,848,451 | 11/1974 | Allin | 72/402 |

*Primary Examiner*—C.W. Lanham
*Assistant Examiner*—Gene P. Crosby

[57] ABSTRACT

An improved tool for applying radial stresses to a tubular splicer to deform the splicer radially inwards about adjacent ends of a pair of aligned reinforcing bars to lock the splicer to the bar ends. A support mechanism is also provided for attachment to a first of the reinforcing bars to support the tool while the radial stresses are created.

6 Claims, 10 Drawing Figures

FIG. 2
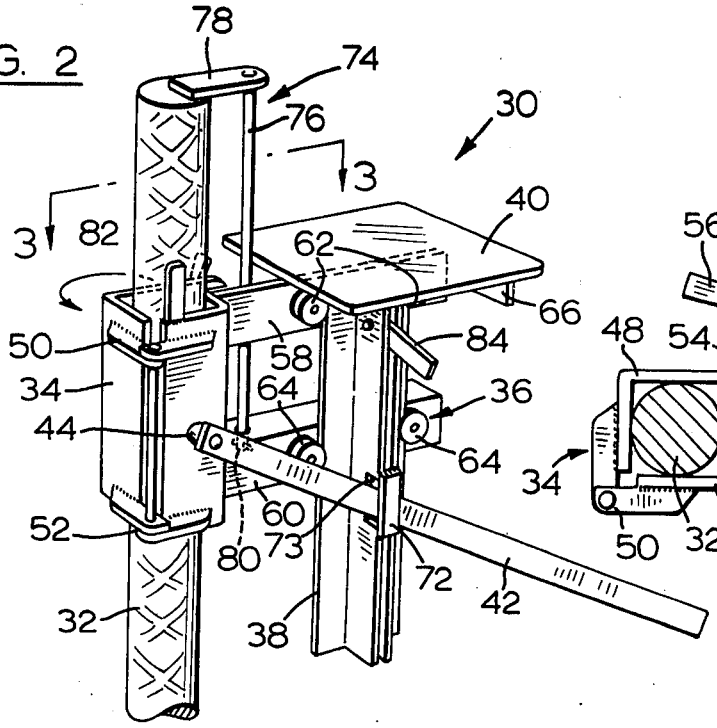
FIG. 3
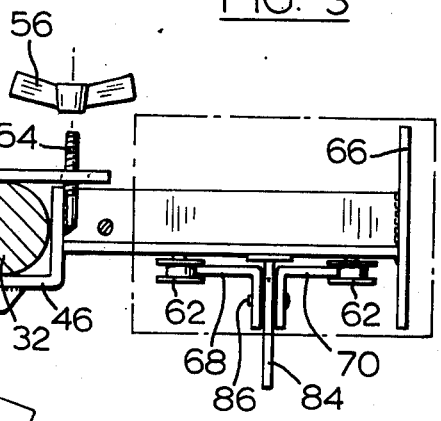
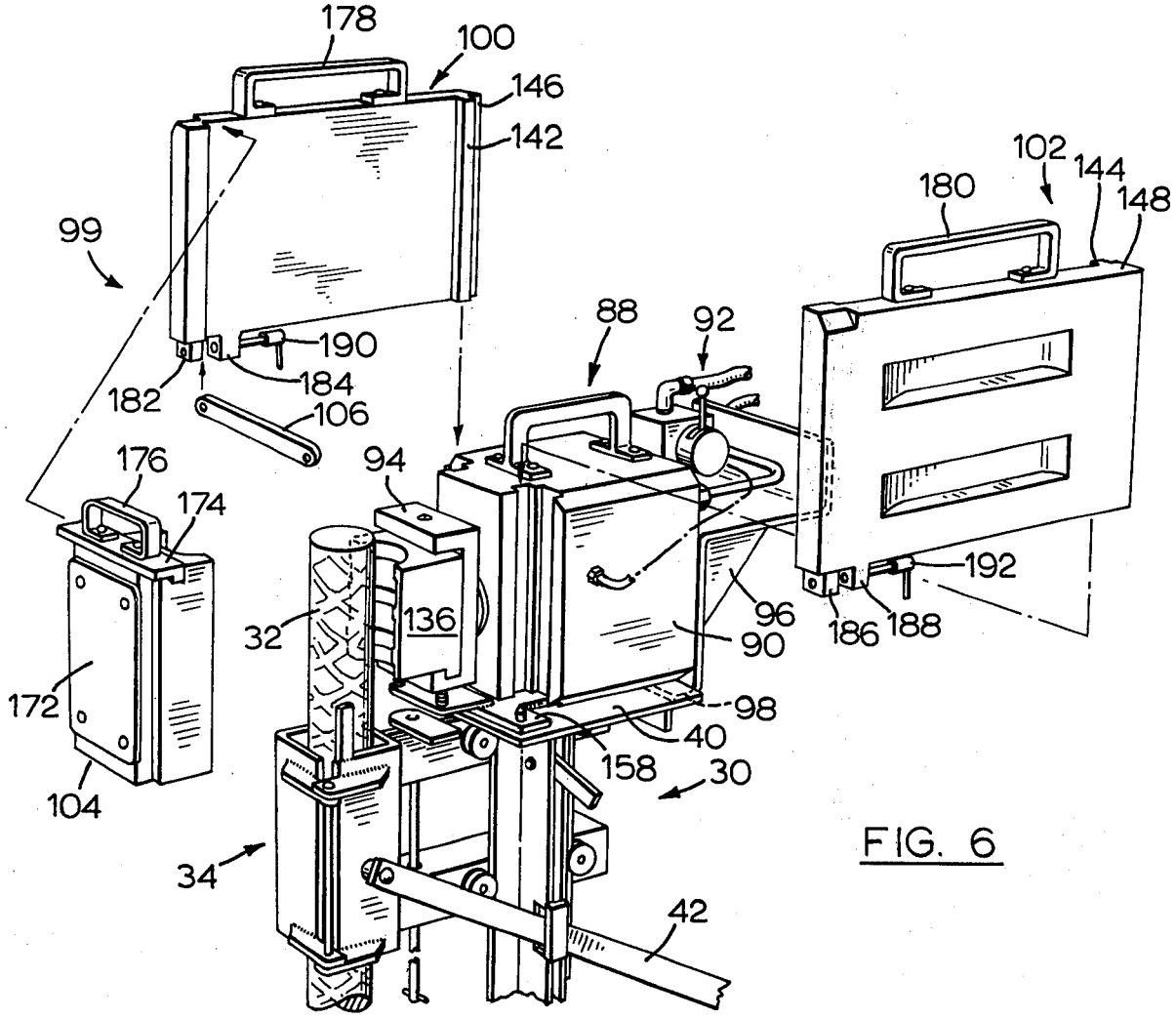
FIG. 6

SPLICER FOR REINFORCING BARS

This invention relates to apparatus for use in applying a tension splicer to adjacent ends of two reinforcing bars to retain the bars in end-to-end engagement.

In buildings of reinforced concrete, a large quantity of heavy reinforcing bar is used to make columns and beams in the building. The columns and beams are linked by floors to form a shell and then fascia panels or the like are mounted on the floor and supported by the columns.

Two types of reinforcing bar splicers are available commercially for attaching adjacent reinforcing bars in end-to-end engagement. A first of the types is used in compressive loading situations and a second type is used where tensile stresses are also anticipated. The present invention provides improved apparatus for applying splicers of the latter type to reinforcing bars.

When applying splicers in reinforcing steelwork, the tool must be manoeuvred around reinforcing bars and assembled splicers. Consequently, it is essential that the tool be shaped and arranged to provide maximum usage between closely-spaced bars and splicers.

Accordingly, in one of its aspects the present invention provides an improved tool for applying radial stresses to a tubular splicer to deform the splicer radially inwards about reinforcing bar ends to lock the splicer to the bar ends. The tool consists of an actuator for movement radially relative to the splicer, a reaction die in alignment with the action die, and a pair of side members removably coupled to the actuator and to the reaction die to transmit stresses from the reaction die to the actuator, the action and reaction dies being shaped to fit snugly about the splicer so that when the actuator applies a radial force, the splicer is deformed radially between the action and reaction dies.

In another of its aspects, the present invention provides apparatus for use in attaching a tubular splicer to adjacent ends of aligned reinforcing bars, the apparatus comprising a combination of a support mechanism and the aforementioned improved tool. The support mechanism is adapted to be attached to a first of the reinforcing bars adjacent an end of this bar for supporting the tool which deforms the splicer radially into engagement with the reinforcing bar and which also deforms the splicer radially into contact with a second of the reinforcing bars. The support mechanism includes a clamp for attaching the mechanism to the first reinforcing bar, a guide coupled to the clamp, a column movable in the guide in parallel relationship with the first reinforcing bar, a table attached to an end of the column nearest to the second reinforcing bar, and supporting the tool, and means adapted to move and locate the column between a first position in which the tool is aligned for deforming the splicer into engagement with the first reinforcing bar, and a second position in which the tool is in alignment for deforming the splicer into engagement with the second reinforcing bar.

The invention will be better understood with reference to the drawings, in which:

FIG. 2 is a perspective view of a preferred embodiment of a support mechanism positioned on an upper end of lower reinforcing bar, the support mechanism being in a lower position;

FIG. 3 is a sectional top view on line 3—3 of FIG. 2;

FIG. 6 is a perspective view of a preferred embodiment of a tool being assembled on the support mechanism in the lowered position;

Figure 1:
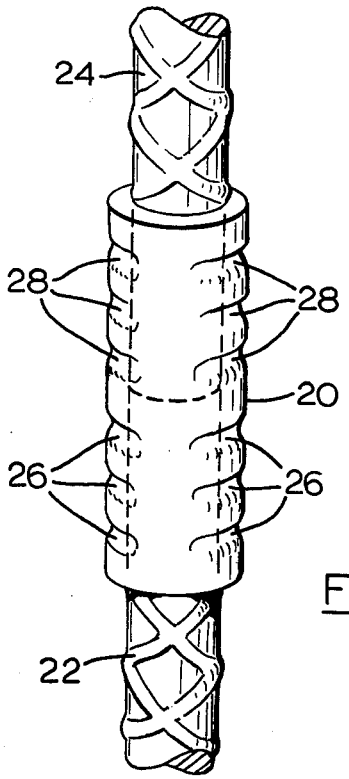
FIG. 1 illustrates a tension splicer applied to adjacent ends of a pair of aligned reinforcing bars, the splicer being of a type which is applied by apparatus according to the invention.

Reference is first made to FIG. 1 which illustrates a tension splicer 20 attached to adjacent ends of a lower reinforcing bar 22 and an upper reinforcing bar 24. The splicer 20 has been applied to the reinforcing bars preferably by first heating the splicer; locating the splicer on the lower reinforcing bar 22; entering the upper splicer 24; and applying radial forces first to create lower deformations 26, and then to create upper deformations 28 thereby engaging the splicer tightly about the respective bars 22, 24.

There are two parts to the apparatus, namely a support mechanism which can be attached to the lower reinforcing bar 22 and a tool which sits on the support mechanism for creating the deformations 26, 28. The apparatus will be described as it would be used.

Figure 4:
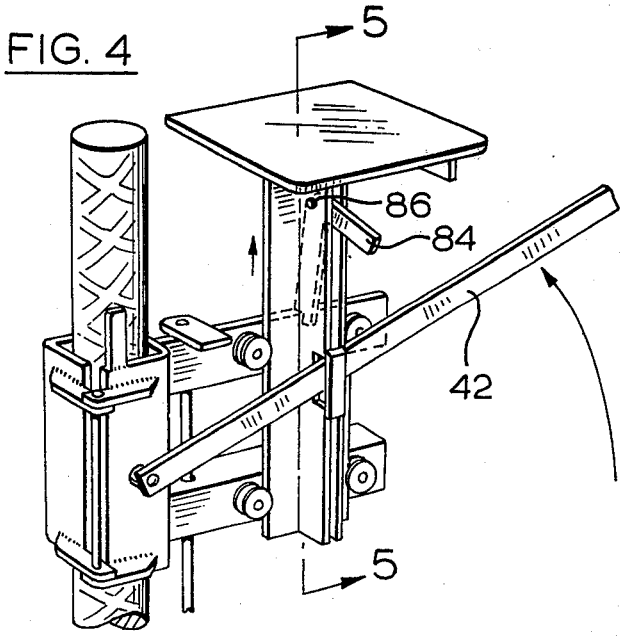
FIG. 4 is a view similar to FIG. 2 showing the support mechanism in a raised position.

Reference is now made to FIG. 2 to show a suitable support mechanism 30 according to the invention. The mechanism is attached to a lower reinforcing bar 32 by a clamp 34. A guide mechanism 36 is attached to the clamp 34 for restraining a column 38 to move vertically. A table 40 is attached to the top of the column for supporting a tool (as will be described) and a lever 42 is pivotally attached at 44 to the clamp 34 and contained in the column 72 for lifting the column and table 40 from a lowered position shown in FIG. 2 into a raised position which is seen in FIG. 4.

The clamp 34 is also seen in FIG. 3 and consists of respective first and second angle elements 46, 48 interconnected by a pair of hinges 50, 52. The angle element 46 has a threaded element 54 which extends through an outwardly opening slot in the element 48 so that the element 48 can be moved about the hinges 50, 52 without interference with the element 54. The element 48 moves between an open position which allows the clamp to be positioned about the reinforcing bar 32 and a closed position shown in FIG. 3. A heavy wing nut 56 is available for engagement on the threaded element to lock the angle elements 46, 48 about the reinforcing bar. It will be evident that the angle elements 46, 48 are proportioned to permit the wing nut 56 to lock the clamp 34 about the reinforcing bar 32. A different clamp is normally used with each size of reinforcing bar.

Figure 5:
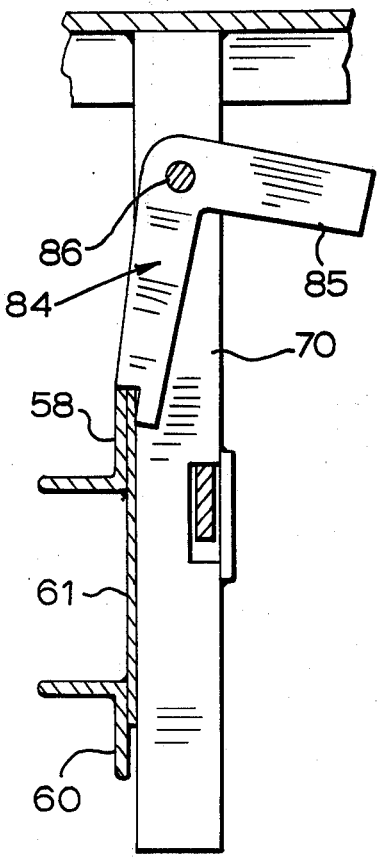
FIG. 5 is a sectional end view on line 5—5 of FIG. 4.

The guide mechanism 36 consists of a pair of parallel bars 58, 60 extending perpendicularly from the angle element 46 and interconnected by a plate 61 (FIG. 5). The bars 58, 60 support respective pairs of guide rollers 62, 64. Table 40 is welded to the upper extremity of the bar 58 and a transverse rib 66 is provided under the table 40 to strengthen the connection between the table and the bar 58. The column 38 consists of a pair of back-to-back angle pieces 68, 70 which are welded at their upper extremities to the underside of the table 40 and retained in spaced-apart relationship by a small plate 72 which also serves to retain the lever 42 in a slot 73 in the column 38. As seen in FIG. 3, outer extremities of the angle pieces 68, 70 locate in the respective guide rollers 62 and 64 (FIG. 2) so that the column 38 is guided for vertical movement relative to the clamp 34 and guide mechanism 36.

When assembling the support mechanism 30 on the reinforcing bar 32, it is important to ensure that the clamp 34 is positioned relative to the upper end of the bar 32 such that when the tool is placed on the table 40, the tool is in a correct position for creating the deformations 26 (FIG. 1). To this end, a simple indicator 74 is included in the mechanism 30. The indicator includes a vertically extending rod 76 having a short arm 78 at its upper extremity and located in the bars 58, 60 for vertical movement relative to these arms. Upward movement of the rod 76 is limited by a pin 80 at the lower end of the rod. This pin engages the bar 60 when the rod 76 has been moved upwardly to the limit of its travel so that the indicator 74 is then in position to locate the support mechanism 30 relative to the upper end of the reinforcing bar 32. Accordingly, the mechanism is first positioned on the reinforcing bar with the indicator fully raised and then the clamp 34 is tightened about the reinforcing bar. The rod 76 of the indicator 74 is then rotated to move the arm 78 out of engagement with the reinforcing bar 32 so that the indicator 74 can be allowed to fall until the arm 78 engages the bar 58 as seen in FIG. 6. The indicator is then in a lowered position where it will not interfere with the operation of the tool when the tool is placed on the table 40.

The mechanism 30 also includes a location piece 82 at the upper end of the clamp 34 for locating a splicer on the reinforcing bar 32. As will be described, when the splicer is dropped over the top end of the reinforcing bar, the bottom of the splicer engages the location piece 82 at which point half of the splicer is positioned over reinforcing bar 32.

As previously mentioned the mechanism 30 has two positions. In FIG. 2, the table 40 is in a lowered position and operation of the lever 42 upwardly moves the table and column 38 upwardly into a raised position shown in FIG. 4. A simple latch 84 (which is better seen in FIG. 5) is pivotally connected at 86 between the angle pieces 68, 70 and balanced so that a notched lower end of the latch 84 tends to engage on the top of the bar 58 to retain the table 40 in the raised position. The latch can be released by lifting an exposed outer end 85 of the latch while applying an upward force to the lever. The table can then be lowered by lowering the lever 42 while at the same time holding the latch out of engagement with the arm 58.

Figure 8:
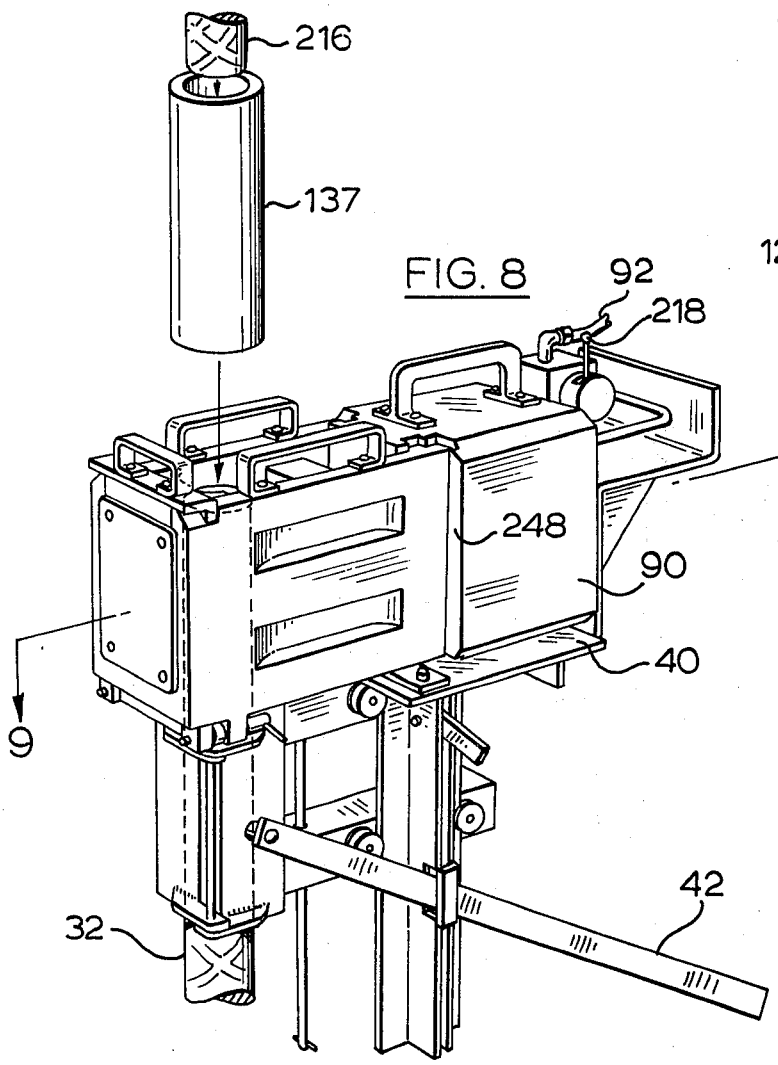
FIG. 8 is a view similar to FIG. 6 showing the tool assembled preparatory to completing the installation of a splicer.

After the support mechanism 30 has been positioned on the reinforcing bar 32, a tool 88 is positioned on the table 40 as will now be described with reference to FIG. 6. The tool 88 includes an hydraulic actuator 90 operable by a control system 92 to cause movement of a die holder 94 towards the reinforcing bar 32. The control system 92 is attached by a bracket 96 to the rear of the actuator 90 and a lip 98 at the bottom of the bracket 96 projects under the table 40 to prevent the tool tipping forwardly towards the reinforcing bar after complete assembly. As will be described, a reaction assembly 99 can be coupled to the actuator 90 and consists essentially of respective side members 100 and 102, a reaction die 104, and a tie bar 106. The complete assembly of the tool is shown in FIG. 8.

Before completing the description of the interrelation of the parts shown in FIG. 6, the actuator 90 will be described with reference to FIG. 9. As seen in this figure, the actuator includes a main housing 108 defining a cylindrical chamber 110 which contains a plunger 112. The outer end of the chamber 110 is closed by an end cap 114 which is threadably engaged in the mouth of the chamber and includes a suitable peripheral seal 116 in engagement with the wall of the chamber. The end cap 114 is locked in the chamber by suitable grub screws 118 which prevent rotation of the end cap 114 relative to the housing 108.

The housing 108 defines a cylindrical bore 120 which extends forwardly from the chamber 110 and is coaxial with the chamber. The plunger 112 includes a rearward portion 115 having a peripheral seal 116 in engagement with the wall of the chamber 110 and a cylindrical forward portion 122 which is a sliding fit in the bore 120 and is sealed by respective seals 124, 126 positioned at ends of the bore 120. With the plunger withdrawn so that the rearward portion 115 is adjacent the end cap 114, the forward portion 122 projects beyond the housing 108 and defines an annular groove 128. This groove receives parts of a split ring 130 which engages loosely in the groove 128 and is attached by suitable screws 132 to the die holder 94 which has a concave spherical contour in engagement with a corresponding convex spherical contour on the end of the plunger 112. The split ring 130 provides sufficient movement in the groove 128 to allow the die holder 94 to move angularly in any direction to ensure alignment of the die holder 94. This holder will be described in further detail with reference to FIG. 7 after first returning to FIG. 6 to complete description of the tool 88. At the present time it is sufficient to appreciate that when the action die 136 is brought into engagement with a splicer 137 located on the reinforcing bar 32, the spherical end of the plunger combines with the spherical depression in the die holder 94 to permit the action die 136 to align itself on the splicer 137.

Figure 9:
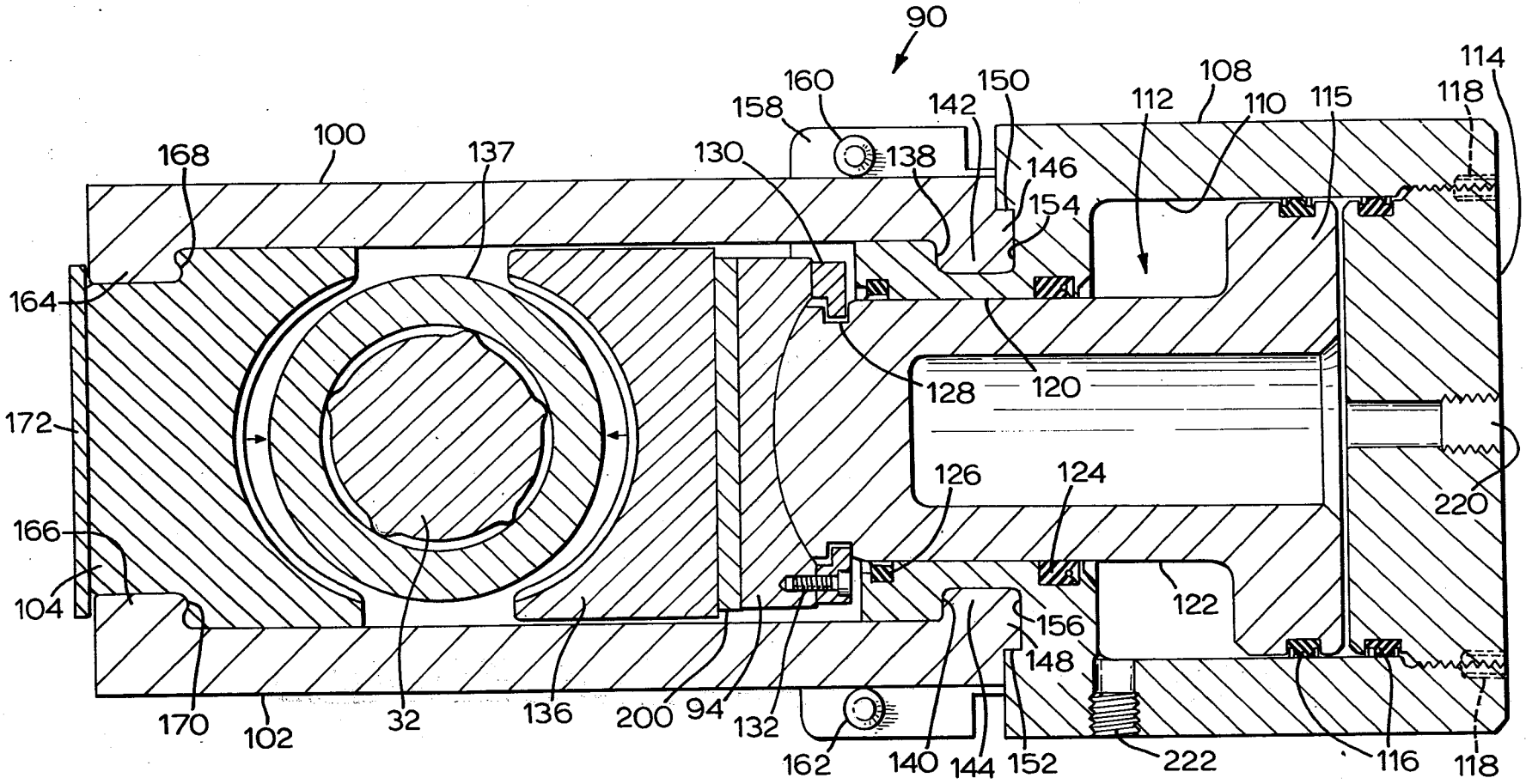
FIG. 9 is a sectional view of the tool on line 9—9 of FIG. 7.

As seen in FIG. 9, the housing 108 also defines a pair of parallel recesses, 138, 140 at opposite sides of the forward portion 122 of the plunger 112. These recesses extend transversely of the line of action of plunger 112 and receive complementary projections 142, 144 (see also FIG. 6) on the side members 100, 102. The projections 142, 144 fit snugly in the respective recesses 138, 140 to ensure that tensile stresses in the side members 100, 102 are transferred to the housing 108 without creating extreme stresses caused by point contacts between the members 100, 102 and the housing 108.

The side members 100, 102 also have end projections 146, 148 which have inclined outer surfaces 150, 152 for combining with similar surfaces forming part of respective recesses 154, 156 which receive the projections 146, 148. The arrangement of these surfaces is such that when the side members 100, 102 are moved downwardly into the housing 108 to engage the respective projections 142, 144 and 146, 148 in the housing, the projections 142, 144 are moved into their proper snug alignment in the housing by the interengagement of the inclined surfaces associated with the projections 146, 148 and recesses 154, 156. However, the tolerances of these parts are such that the side members 100, 102 engage a bottom plate 158 before the projections 146, 148 become wedged in the recesses 154, 156.

The bottom plate 158 also supports a pair of short upstanding pins 160, 162 which are positioned to limit spreading of the side arms 100, 102 before the reaction die 104 is engaged in the arms as will now be described.

The respective outer ends of the side arms 100, 102 terminate in inwardly facing projections 164, 166 having contoured side faces 168, 170 for mating with complementary faces formed in the reaction die 104. The faces are shaped in this manner to limit stress concentrations resulting from sudden changes in contour and also to limit separation of the side arms 100, 102 from the reaction die 104. A plate 172 is attached to the die 104 and extends beyond upright ends of the die for locating loosely against ends of the respective side members 100, 102 so that the die 104 cannot fall towards the splicer 137. As seen in FIG. 6, a top bar 174 is attached to the top of the die 104 to prevent the die from falling vertically from the side members 100, 102. A suitable handle 176 is also provided at the top of the die 104 for lifting the die into position between the side members 100, 102.

Returning now to FIG. 6, the side members 100, 102 have respective handles 178, 180 for lifting the side members, and at their lower outer extremities, the side members include respective pairs of lugs 182, 184 and 186, 188. The pairs of lugs are spaced sufficiently to receive the tie bar 106 and openings in the lugs and tie bar are arranged to permit locking pins 190, 192 which are normally stored in the respective lugs 184, 188 to be engaged through the lugs and tie bar to retain the side members 100, 102 in proper spaced relationship about the reaction die 104.

As also seen in FIG. 6, the die holder 94 supports the action die 136 vertically. As better seen in FIG. 7, the die 136 has a downwardly extending projection 194 engaged behind a lip 196 at the mouth of a large recess 198 containing part of the die 136. A heat shield 200 of asbestos or other suitable material is also positioned in the recess 198 and is normally compressed slightly between the die 136 and the holder 94. This compression is caused by the action of a location screw 202 which has a conical end for engagement in a corresponding recess 204 in the die 136. The recess 204 is positioned so that there is a component of the tightening force from the screw 202 causing the die 136 to tend to move towards the holder 94. This tendency for movement is emphasized by the inclusion of suitably inclined mating faces on the projection 194 and lip 196 so that as the screw 202 is tightened, the die 136 tends to slide down the face on the lip 196 and into engagement with the heat shield 200.

Figure 7:
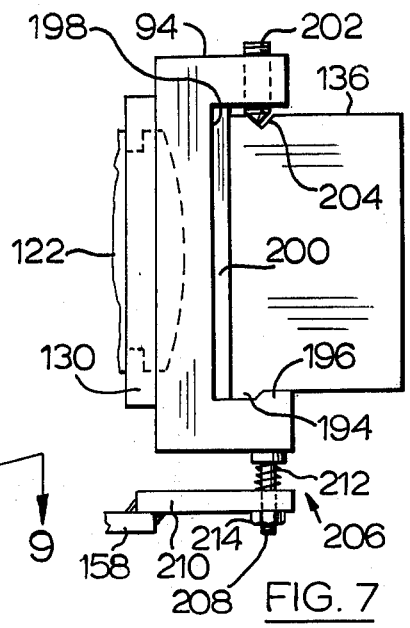
FIG. 7 is a side view of part of the tool and showing an action die and a holder.

As also seen in FIG. 7, the die 136 and holder 94 are maintained in general alignment with the plunger 112 (FIG. 9) by a support device 206. This device includes two bolts 208 (both of which can be seen in FIG. 6) which are engaged in a plate 210 welded to the bottom plate 158. The heads of the bolt 208 are biased upwardly by compression springs 212 and are adjusted vertically by nuts 214 which maintain compressions in the respective springs 212. Although the springs are sufficiently strong to support the die 136 and holder 94, the springs will allow the bolts to move downwardly should the die 136 align itself in use by moving downwardly relative to the axis of the plunger 112 (FIG. 9).

Returning to FIG. 6 to describe the assembly and use of the apparatus, the tool is placed on the table 40 and moved forwardly to engage the lip 98 of the bracket 96 under the rearward edge of the table 40. Next, the side members 100, 102 are engaged in the actuator 90 and then the tie bar 106 is attached to the side members using the locking pins 190, 192. Finally, the reaction die 104 is engaged in the ends of the side members 100, 102. The assembly is then complete and is ready for use as shown in FIG. 8. Next, as seen in FIG. 8, the tension splicer 137 is dropped onto the reinforcing bar 32 and as previously described with reference to FIG. 2, the splicer rests on the location piece 82 (FIG. 2). It should be understood that the tension splicer is preferably heated at this point for improved deformation. Next, a lower end of a further reinforcing bar 216 is lowered into the splicer 137 until the lower end of this bar abuts against the upper end of the bar 32. The control system 92 is then actuated. The system is essentially a source of hydraulic pressure which is fed through a typical hydraulic system and controlled by a lever 218. When it is desired to apply a force to the splicer 137, the lever is positioned such that oil is fed to a port 220 (FIG. 9) in the actuator 90 so that the plunger 112 is forced to move axially towards an advanced position. At the same time, oil trapped in front of the end portion 115 is allowed to escape through a port 222 and is fed back to a reservoir (not shown). When the action die 136 meets the splicer 137, further movement of the plunger results in drawing the actuator axially to bring the reaction die 104 into engagement with the splicer 137. This movement is permitted because the actuator 90 simply rests on the table 40. As the forces increase about the splicer 137, the action die 136 aligns itself against the splicer 137 and consequently allows the die 104 to do the same. The forces increase until a predetermined oil pressure is reached at which time the radial deformations 26 (FIG. 1) have been formed.

The control lever 218 is then moved into a position to supply oil into the port 222 (FIG. 9) to thereby move the plunger 112 back into the position shown in FIG. 9 and to allow oil to flow out of the port 220 back into the aforementioned reservoir. kThe elevating lever 42 (FIG. 8) is then raised upwardly to move the tool into a position in which it can be used to make the radial deformation 28 (FIG. 1) in the splicer 137. Once the plunger 112 (FIG. 9) in the actuator 90 has been withdrawn, the tool can be removed from the completed splicer by reversing the assembly procedure. However, one of the advantages of the tool is that it can be diassembled in several ways. For instance, if it is convenient to do so, the side members 110, 102 reaction die 104 can be lifted as a unit by gripping the handles 178, 180 and lifting vertically until the side members are clear of the actuator 90. The unit can then be moved away from the actuator and from the reinforcing bars. The actuator can then be lifted off the support mechanism 30 and this mechanism can then be removed from the reinforcing bar 32 and then attached to a further reinforcing bar. It may be preferable for speed of operation to use two supporting mechanisms so that the actuator 90 can be lifted immediately off one mechanism and onto the next so that a further splicer is being installed while the first support mechanism is removed from the reinforcing bar 32.

The arrangement of reinforcing bars in a particular structure may be such that it is preferable to remove the reaction die 104 from the side members 100, 102 before lifting the actuator from the table 40. In this event, the actuator together with the side members can be lifted as a single unit if this is convenient. Further, as a third alternative, the reaction die, tie bar 106, and side members 100, 102 can be removed individually in a situation in which such disassembly is necessary.

During use with a hot splicer 137, heat is passed to the dies 136 and 104 and consequently after installing a number of splicers it may be necessary to change the dies to avoid overheating a particular pair of dies. This can be done conveniently because as previously described the reaction die 104 can be lifted from the side members 100, 102 and the die 136 can be removed by releasing the location screw 202 (FIG. 7) and lifting the die 136 out of the holder 94.

It will be evident that different sizes of dies must be used for different sizes of sleeves and also that the support mechanism 30 must be changed because the clamp 34 is made to fit a particular reinforcing bar. Further, if the length of the splicer 137 is changed, then the support mechanism must produce a different lift between the lowered and raised positions to match the lenght of such a splicer.

Figure 10:
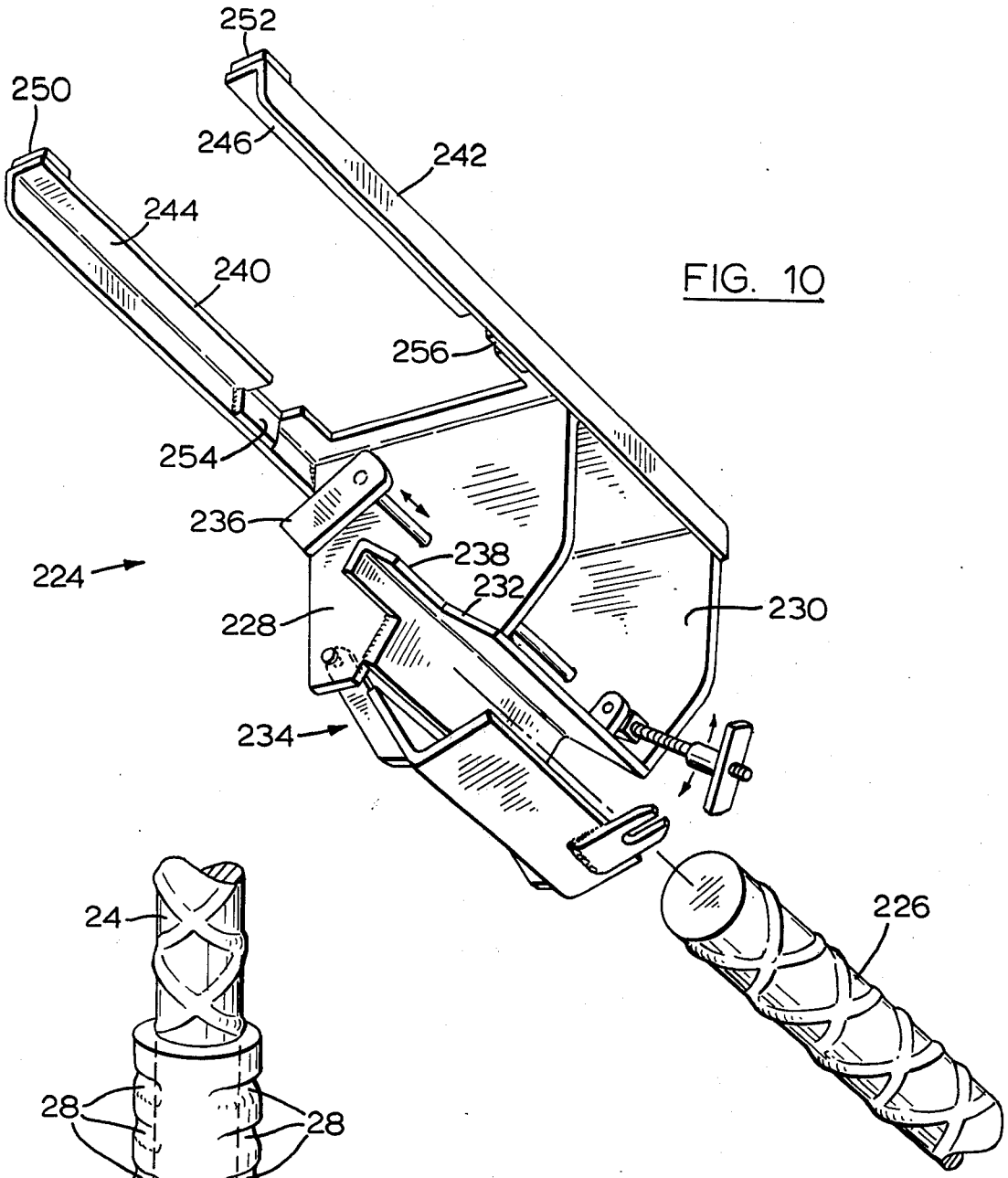
FIG. 10 is a perspective view showing the underside of an alternative embodiment of the support mechanism.

Although a large proportion of reinforcing steel work requires the application of splicers to vertical reinforcing bars, there are instances in which tension splicers must be applied to reinforcing bars which are extending horizontally. In such a situation, the support mechanism 30 (FIG. 2) is not entirely satisfactory. FIG. 10 illustrates a further support mechanism 224 about to be attached to a horizontally extending reinforcing bar 226. The mechanism 224 consists of a pair of vertically extending plates 228, 230 interconnected at their lower extremities by an angle element 232 which corresponds to the angle element 46 described with reference to FIGS. 2 and 3. The angle element 232 forms part of a clamp 234 which because of its similarity with the clamp 34 (FIG. 2) will not be described in any further detail. Similarly, an indicator 236 is slidably engaged in the plates 228, 230 and corresponds in form to the indicator 74 also described with reference to FIG. 2.

The angle element 232 includes a projection 238 which extends past the plate 228 for use in locating the splicer in a similar fashion to the location piece 82 (FIG. 2).

A pair of elongated angle elements 240, 242 are also attached to the plates 228, 230 and extend outwardly beyond the plate 228 in parallel alignment with the calmp 234. Consequently, when the clamp 234 is attached to the bar 226, the angle elements 240, 242 are parallel to the axis of the bar 226. Top flanges 244, 246 of the elements 240, 242 are positioned so that when the tool 88 is positioned with the die 136 below the actuator 90, there are a pair of faces 248 (one of which is seen in FIG. 8) on the actuator 90 which rest on the respective flanges 244, 246. The distance between these flanges is such that the side members 100, 102 are in sliding engagement with inner edges of the flanges. The tool is positioned so that the top of the actuator 90 shown in FIG. 6 faces towards the plate 230. In this position when the tool is moved on the angle elements 240, 242 towards the projecting ends of these elements, the bottom of the actuator 90 (as drawn in FIG. 6) meets a pair of stops 250, 252 welded to the element to locate the tool at one end of its travel. The tool can then be moved along the elements 240, 242 until the plate 158 under the side members 100, 102 meets a pair of stops 254, 256 which are also welded to the elements 240, 242. In use, the tool is first positioned using the stops 254, 256 to attach a splicer to the reinforcing bar 226 and then the tool is moved until the stops 250, 252 locate the tool for deforming the splicer about a further reinforcing bar which is aligned with the reinforcing bar 226 in end-to-end engagement therewith.

We claim:

1. A tool for applying radial forces to a tension splicer to deform the splicer radially into contact with adjacent end portions of reinforcing bars arranged in end-to-end alignment within the splicer, the tool comprising:

a housing;

a plunger movable longitudinally in the housing and normally in a withdrawn position;

control means coupled to the housing and operable to cause the plunger to move longitudinally between an advanced position and said withdrawn position;

a die holder coupled to the plunger for movement with the plunger;

an action die disposed about a transverse axis and held in place by the die holder;

a pair of side members releasably coupled to the housing and projecting longitudinally from the housing in parallel relationship, the side members being independently movable in parallel with said transverse axis to remove the side members from the housing; and a reaction die releasably coupled to the side members remote from the housing and disposed about a second transverse axis parallel to the first mentioned transverse axis, and movable in parallel with said transverse axes relative to the side members to remove the reaction die from the side members, the reaction die combining with the action die to compress the splicer into engagement with the end portions of the reinforcing bars upon operating the control means to move the plunger from the withdrawn position to the advanced position.

2. A tool as claimed in claim 1 and further comprising a tie bar and means adapted to releasably couple the tie bar to the side members adjacent the reaction die to maintain the spacing between the side members when the reaction die is removed from the side members.

3. A tool as claimed in claim 1 and further comprising spherical interfaces between the plunger and the die holder to permit self-alignment of the action die as the action die engages the splicer.

4. A tool as claimed in claim 3 and further comprising a support device coupled to the housing and located below the die holder with the tool orientated to operate on vertical said reinforcing bars, the support device being adapted to maintain the die holder and action die in alignment with the plunger while permitting said self-alignment.

5. In combination, a support mechanism and a tool as claimed in claim 1, the support mechanism being adapted to be releasably attached to a first of the reinforcing bars adjacent an end of this bar for supporting the tool which deforms the splicer radially into engagement with the reinforcing bar and which also deforms the splicer radially into contact with a second of the reinforcing bars, the support mechanism comprising:

a clamp adapted to releasably grip the first reinforcing bar;

a guide mechanism attached to the clamp;

a column engaged in the guide mechanism for guided movement parallel to the axis of the reinforcing bars;

a table attached to an upper end of the column and adapted to support the tool in position for deforming the splicer;

lever means coupled to the clamp and to the column and operable to move the column vertically between a lower position in which the tool is aligned for deforming the splicer into engagement with the first reinforcing bar and a raised position in which the tool is aligned for deforming the splicer into engagement with the second reinforcing bar; and means adapted to locate the column in the raised and lowered positions.

6. The combination as claimed in claim 5 and further comprising an indicator engageable on the end of the first reinforcing bar for locating the support mechanism relative to an upper end of the first reinforcing bar so that the clamp can be engaged on the first reinforcing bar in proper alignment for deforming the sleeve into engagement with this bar.

* * * * *